US006196799B1

(12) United States Patent
Fukue et al.

(10) Patent No.: US 6,196,799 B1
(45) Date of Patent: Mar. 6, 2001

(54) GAS TURBINE MOVING BLADE PLATFORM

(75) Inventors: Ichiro Fukue; Eiji Akita; Kiyoshi Suenaga; Yasuoki Tomita; Koji Watanabe, all of Takasago (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 09/252,064

(22) Filed: Feb. 18, 1999

(30) Foreign Application Priority Data

Feb. 23, 1998 (JP) ..... 10-040106
Mar. 3, 1998 (JP) ..... 10-050443

(51) Int. Cl.[7] ..... F01D 5/18
(52) U.S. Cl. ..... 416/97 R
(58) Field of Search ..... 415/115, 116; 416/95, 96 R, 96 A, 97 R, 97 A

(56) References Cited

U.S. PATENT DOCUMENTS

| | | | |
|---|---|---|---|
| 3,066,910 | * 12/1962 | Bluck | 416/96 R |
| 4,040,767 | 8/1977 | Dierberger et al. . | |
| 4,134,709 | 1/1979 | Eskesen . | |
| 4,672,727 | 6/1987 | Field . | |
| 5,382,135 | 1/1995 | Green . | |
| 5,609,466 | 3/1997 | North et al. . | |
| 5,639,216 | 6/1997 | McLaurin et al. . | |
| 5,848,876 | 12/1998 | Tomita . | |

FOREIGN PATENT DOCUMENTS

| | | |
|---|---|---|
| 19807563 | 9/1998 | (DE) . |
| 2050529 | 1/1981 | (GB) . |
| 08082201 | 3/1996 | (JP) . |
| 8-246802 | 9/1996 | (JP) . |
| 09280002 | 10/1997 | (JP) . |
| 10-238302 | 9/1998 | (JP) . |
| 96/13653 | 5/1996 | (WO) . |

* cited by examiner

*Primary Examiner*—Christopher Verdier
(74) *Attorney, Agent, or Firm*—Wenderoth, Lind & Ponack, L.L.P.

(57) ABSTRACT

A gas turbine moving blade platform having a simplified cooling structure for effecting uniform cooling of the platform. The platform (1) includes cavities (2, 3, 4) and an impingement plate (11) provided below the cavities (2, 3, 4). A cooling hole (5) communicates with cavity (2), cooling hole (6) communicated with cavity (3) and cooling holes (7, 8) communicate with cavity (4) and all of the cooling holes pass through the platform (1) at an inclined angle. Cooling air (70) flows into the cavities (2, 3, 4) through holes (12) in the impingement plate (11) for effecting impingement cooling of platform (1) plane portion. The cooling air (70) further flows through the cooling holes (5, 6, 7) to blow outside angularly upward for cooling peripheral portions of the platform. Thus, the platform is cooled uniformly, no lengthy and complicated cooling passage is provided, and workability is enhanced.

3 Claims, 9 Drawing Sheets

GAS TURBINE MOVING BLADE PLATFORM

BACKGROUND OF THE INVENTION

1. Field of the Invention

The present invention relates to a gas turbine moving blade platform constructed so as to enhance a cooling performance thereof.

2. Description of the Prior Art

FIG. 8 is a cross sectional view of a representative prior art gas turbine moving blade platform. In FIG. 8, numeral 80 designates a platform in its entire form and numeral 51 designates a first stage moving blade. Numeral 52 designates a leading edge passage of the moving blade 51 and cooling passages 83, 84 are communicated with the leading edge passage 52 and extending toward respective side portions of the platform 80. The cooling passages 83, 84 connected to cooling passages 85, 86, respectively, on both side portions and the cooling passages 85, 86 open at a rear end of the platform 80 so that cooling air 70 is blown therefrom, respectively.

Cooling passages 87 and 88, 89 and 90 are provided in a front portion of the platform 80, on both sides thereof and the cooling passages 88 to 90 are bored at an angle from a lower surface toward an upper surface of the platform 80 so as to open at the upper surface so that cooling air is blown therefrom. Also, cooling passages 91, 92, 93 are bored in a rear portion of the platform 80 so as to extend likewise at an angle from the lower surface toward the upper surface of the platform 80 and to open at the rear end thereof so that the cooling air is blown therefrom.

Further, in a central portion of the platform 80, there are provided cooling passages 94, 95, 96, 97, 98 and these cooling passages are also bored at an angle from the lower surface toward the upper surface of the platform 80 so that the cooling air is blown from the upper surface. An outlet end portion of each of the cooling passages 94 to 98 is worked so as to be enlarged in a funnel-like shape so that the cooling air is diffused over the upper surface.

FIG. 9 is a contracted cross sectional view taken on line 9—9 of FIG. 8, wherein the cooling passages 85, 86 are provided in both side portions of the platform 80 and the cooling passage 97 is bored at an angle from the lower surface toward the upper surface of the platform 80.

FIG. 10 is a contracted cross sectional view taken on line 10—10 of FIG. 8, wherein there are provided the cooling passage 85 extending from the front portion toward the rear portion of the platform 80 so as to open at the rear end, and the cooling passages 87, 94 to 98 extend angularly so that the cooling air is blown therethrough rearwardly and upwardly, respectively.

In the platform 80, constructed as above, cooling air which has been supplied into the moving blade 51 through the leading edge passage 52 flows portionally into the cooling passages 85, 86 for cooling of both side portions of the platform 80 to then flow out of the rear end of the platform 80. Also, the cooling passages 87 to 90, 91 to 93, respectively, are inclined in the front and rear portions of the platform 80 so that cooling air is introduced thereinto from the lower surface of the platform 80 so as to flow out of the upper surface of the front and rear end portions of the platform 80. Further, the cooling passages 94 to 98 are inclined in the central portion and cooling air flows therethrough from the lower surface of the platform 80 and out of the upper surface thereof. Thus, the entire portion of the platform 80 is cooled by the cooling air flowing therein and flowing out thereof.

In the representative prior art gas turbine moving blade platform as described above, there are provided linearly extending main cooling passages of the cooling passages 85, 86, and in addition thereto, there are provided a multiplicity of cooling passages of the cooling passages 87 to 90, 91 to 93, etc. which pass through the platform 80 at an angle and thus have a comparatively long inclined route. Hence, in the platform 80, there are provided many such cooling air supply passages and processing or working of the platform itself becomes complicated, and thus it is necessary to develop a cooling structure for the platform which can be made simpler and still has an excellent cooling effect that will cool an entire portion of the platform uniformly.

SUMMARY OF THE INVENTION

It is therefore an object of the present invention to provide a gas turbine moving blade platform in which supply passages and flow passages of platform cooling air are simplified so that processing of the platform is facilitated as well as an entire portion of the platform is cooled uniformly with result that a cooling effect thereof is enhanced.

In order to achieve said object, the present invention provides the following items (1) to (6):

(1) A gas turbine moving blade platform characterized in comprising a cavity formed in the platform around a base portion of the moving blade for introducing thereinto a cooling air. Also, a plurality of cooling holes communicate with the cavity and open at a peripheral end surface of the platform.

(2) A gas turbine moving blade platform as mentioned in item (1) above, characterized in that the plurality of cooling holes are provided at an angle so as to extend upwardly toward the peripheral end surface of the platform from the cavity.

(3) A gas turbine moving blade platform as mentioned in item (1) above, characterized in that there is provided an impingement plate at a bottom portion of the cavity for introducing therethrough the cooling air into the cavity.

(4) A gas turbine moving blade platform as mentioned in item (1) above, characterized in that there is provided a cooling hole passing through the platform at an angle, and communicating at its one end with the cavity and opening at its the other end at an upper surface of the platform.

(5) A gas turbine moving blade platform including two cooling passages, each being provided in the platform on each side of the moving blade, and communicating at its one end with a leading edge passage of the moving blade and having at its other end an opening at a side end surface of the platform. A cover is provided for closing the opening of each of the two cooling passages, and at least three linearly formed cooling passages are formed in the platform. Each of the linear cooling passages communicates at its one end with any one of the two cooling passages and has at its other end an opening at a rear end surface of the platform.

(6) A gas turbine moving blade platform characterized in that the platform includes an upper platform and a lower platform. A cavity is formed between the upper platform and the lower platform on each side of the ventral and dorsal sides of the moving blade. A cooling passage is bored in the upper platform along each of both side portions of the upper platform so as to communicate at its one end with the cavity at a front portion of the platform and its other end opens at a rear end surface of the platform. Also, a multiplicity of cooling holes are bored in the lower platform and pass upwardly through into the cavity thereabove from a bottom surface of the lower platform.

In the platform of item (1) above, the cooling air flows into the cavity formed around the moving blade and the platform around the moving blade forms almost the entire portion of the cavity, thereby substantially the entire platform is cooled uniformly by this cavity. Further, there are provided the plurality of cooling holes, communicating with the cavity, at the peripheral portions of the platform and the cooling air flows out thereof while cooling the peripheral portions. Thus, by the effect of the cavity and the cooling holes of the peripheral portions, the entire portion of the platform is cooled uniformly. Further, the complicated and lengthy cooling passages as seen in the prior art are eliminated and such a simple structure is realized as having only the cavity and the short cooling holes along the peripheral portions. The supply source of the cooling air to the cooling holes is from the cavity only, and hence the work of the platform is facilitated.

In the platform of item (2) above, the cooling holes of item (1) above are inclined, thereby the cooling effect in the thickness direction at the peripheral portions of the platform is increased. In the platform of item (3) above, the cooling air flows into the cavity through the impingement plate, thereby the cooling of the cavity is accomplished efficiently by the effect of the impingement cooling. Also, in the platform of item (4) above, the cooling holes are provided not only at the peripheral portions but also in the upper surface of the central portion of the platform, thereby the cooling of the platform is achieved even more effectively.

In the invention of item (5) above, in order to simplify the platform cooling structure, the number of the linearly formed cooling passages is increased to three or more, which is more than in the prior art. Also, the peripheral cooling holes or the lengthy cooling passages are omitted instead, so that the cooling function of the above-mentioned cavity or cooling holes is effected by the increase of the linear cooling passages. Further, the cooling passages communicating with the leading edge passage of the moving blade are constructed simply so as to pass through the platform to open at both side end surfaces thereof and the opening portions are closed by the covers, thus the workability of the platform is enhanced. By such construction, the platform is made in a structure in which the work process is easy and still the cooling performance is ensured.

In the invention of item (6) above, the cavity is formed between the upper and lower platforms and the cooling air is introduced into the cavity, thereby the entire plane portion of the platform is cooled and both of the side end portions of the platform are cooled by the cooling passages. The cooling air flows into the cavity from the inner side (rotor side) of the platform through the multiplicity of holes provided in the lower platform. The cooling air, which has entered the cavity, flows through the cavity toward the front portion of the platform so as to enter the cooling passages provided on both sides of the moving blade along both of the side portions of the upper platform and then flows out of the rear end surface of the upper platform.

The platform, as constructed, includes the cavity formed between the upper and lower platforms, the cooling passages on both side portions of the upper platform and the multiplicity of holes in the lower platform. Thus, the complicated and inclined passages as seen in the prior art platform cooling structure are eliminated, and thereby a simple structure is realized, workability thereof is enhanced and the platform is cooled uniformly with an enhanced cooling effect.

DETAILED DESCRIPTION OF THE PREFERRED EMBODIMENTS

Figure 1A:
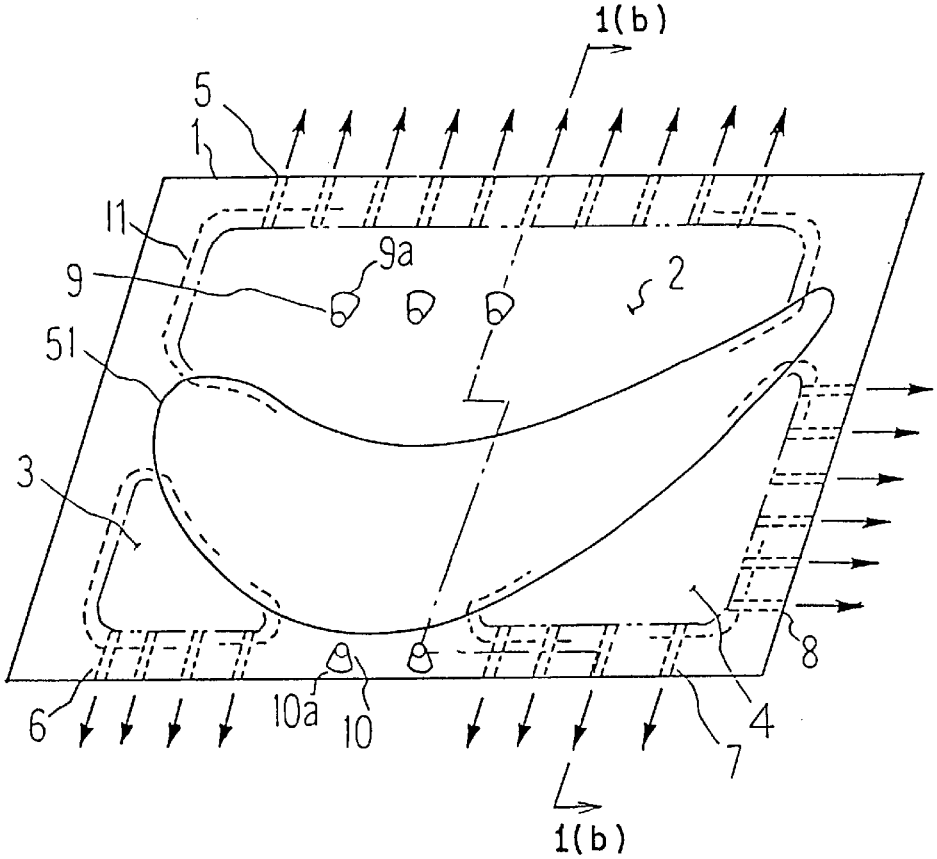
FIGS. 1(*a*)–1(*b*) show a gas turbine moving blade platform of a first embodiment according to the present invention, wherein FIG. 1(*a*) is a plan view of the platform and FIG. 1(*b*) is a cross sectional view taken on line 1(*b*)—1(*b*) of FIG. 1(*a*).
Figure 1B:
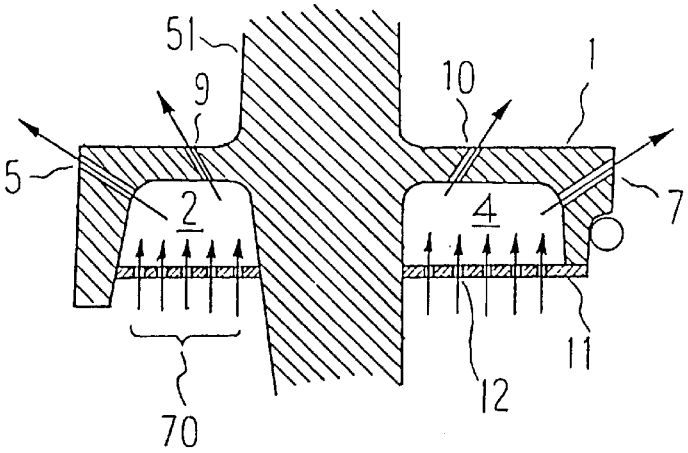

Herebelow, embodiments according to the present invention will be described with reference to accompanying drawing figures. FIGS. 1(*a*)–1(*b*) show a gas turbine moving blade platform of a first embodiment according to the present invention, wherein FIG. 1(*a*) is a plan view of the platform and FIG. 1(*b*) is a cross sectional view taken on line 1(*b*)—1(*b*) of FIG. 1(*a*).

In FIG. 1(*a*), numeral 1 designates a platform and numeral 51 designates a moving blade. Numeral 2 designates a cavity, which is formed in the platform 1 on one side portion thereof. Numerals 3, 4 also designate cavities, which are formed in the platform 1 on the other side portion thereof. Numerals 5, 6, 7, 8 designate a plurality of rows of cooling holes, respectively. The cooling holes 5 are bored in a periphery of the one side portion of the platform 1 at an angle in communication with the cavity 2 so that cooling air is blown therethrough angularly upwardly, as will be described later. The cooling holes 6 are provided in communication with the cavity 3 so that the cooling air is blown therethrough likewise angularly upward in the other side portion of the platform 1 and the cooling holes 7, 8 are provided in communication with the cavity 4 so that the cooling air is blown therethrough angularly upwardly in the other side portion and a rear end portion, respectively, of the platform 1.

Numeral 9, 10 also designate cooling holes, which are provided on both sides of a ventral side and a dorsal side of the moving blade 51 in a central portion of the platform 1 so that the cooling air is blown therethrough likewise angularly upward. In an upper end portion of each of the cooling holes 9, 10, there is formed an enlarged funnel-like portion, as shown by numerals 9*a,* 10*a,* so that the cooling air diffuses therefrom on an upper surface of the platform 1.

In FIG. 1(*b*) which is a cross sectional view taken on line 1(*b*)—1(*b*) of FIG. 1(*a*), the cavities 2, 4 are formed in the platform 1, and therebelow an impingement plate 11 is fitted for closing the cavities 2, 4. Cooling air 70 is introduced through a multiplicity of holes 12 provided in the impingement plate 11 so that the cavities 2, 4 are cooled by impingement cooling. The cavity 3 is also fitted with an impingement plate 11 so as to be cooled by the is impingement cooling.

On one side of the platform 1, there are provided the cooling holes 5 communicating with the cavity 2 and extending angularly upward so as to open at a side end of the one side of the platform 1 for blowing the cooling air angularly upward and the cooling holes 9 for blowing the cooling air likewise angularly upward at the central portion of the platform 1.

Also, on the other side of the platform 1, there are provided the cooling holes 7 extending angularly upward to open at a side end of the other side of the platform 1 for blowing the cooling air angularly upward and the cooling holes 10 for blowing the cooling air likewise angularly upward at the central portion of the platform 1.

In the platform 1 of the first embodiment constructed as above, the cooling air 70 flows into the cavities 2, 3, 4 from a blade root portion of the moving blade 51 through the holes 12 of the impingement plate 11 for effecting the impingement cooling of these portions of the cavities, and thereby the main portions around the moving blade 51 of the platform 1 are cooled uniformly. The cooling air further flows angularly upward through the cooling holes 5, 6, 7, 8 from the cavities 2, 3, 4 so as to flow out angularly upward from both side portions and rear portion of the platform 1 while cooling respective peripheral portions of the platform 1 from lower portions to upper portions thereof.

Thus, according to the platform 1 as described above, the complicated passages, as have been seen in the prior art, are eliminated and the construction of the platform 1 is made such that main portions of the platform 1 are cooled entirely uniformly by the cavities 2, 3, 4 and the impingement plate 11 and the peripheral portions are cooled by the cooling air flowing out of the cavities 2, 3, 4, respectively, through the multiplicity of cooling holes 5 to 10 which extend angularly upward over a comparatively short length, thereby the processing of the platform 1 becomes simplified and the entire portions including the peripheral portions of the platform 1 can be cooled uniformly without employing complicated and lengthy cooling passages.

Figure 2A:
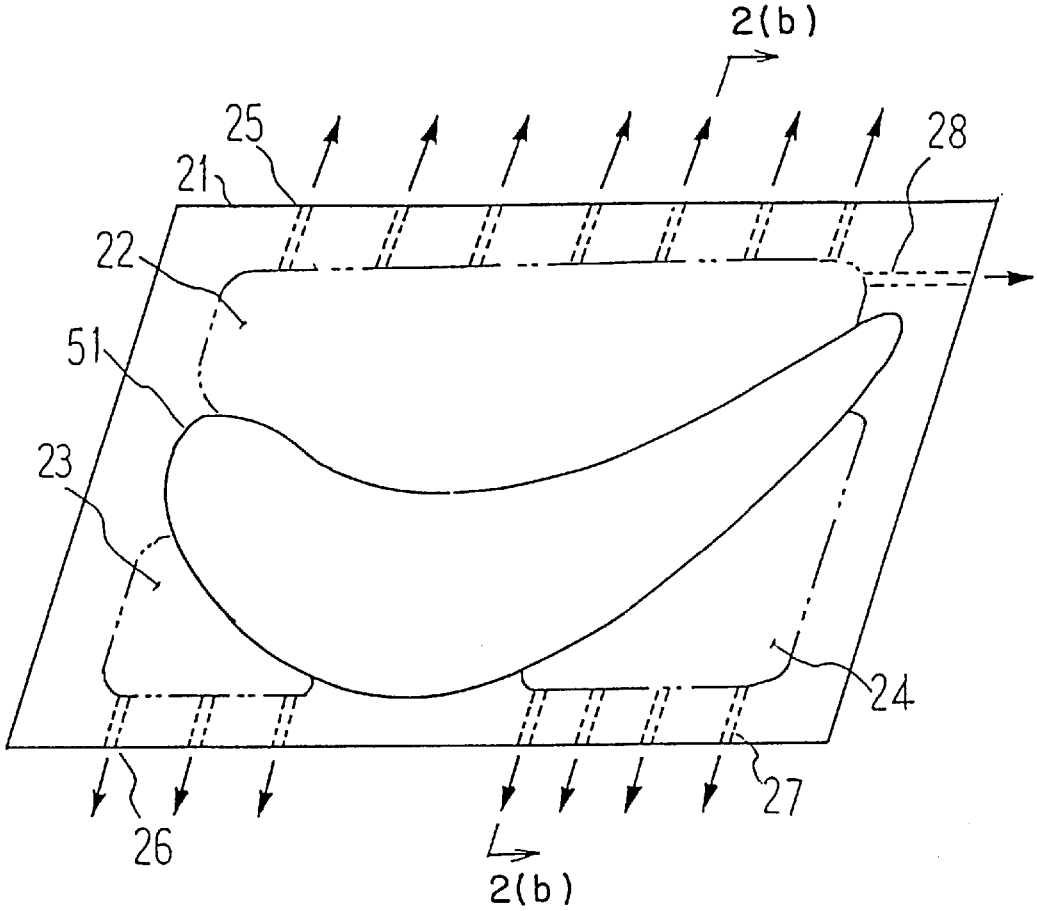
FIGS. 2(*a*)–2(*b*) show a gas turbine moving blade platform of a second embodiment according to the present invention, wherein FIG. 2(*a*) is a plan view of the platform and FIG. 2(*b*) is a cross sectional view taken on line 2(*b*)—2(*b*) of FIG. 2(*a*).
Figure 2B:
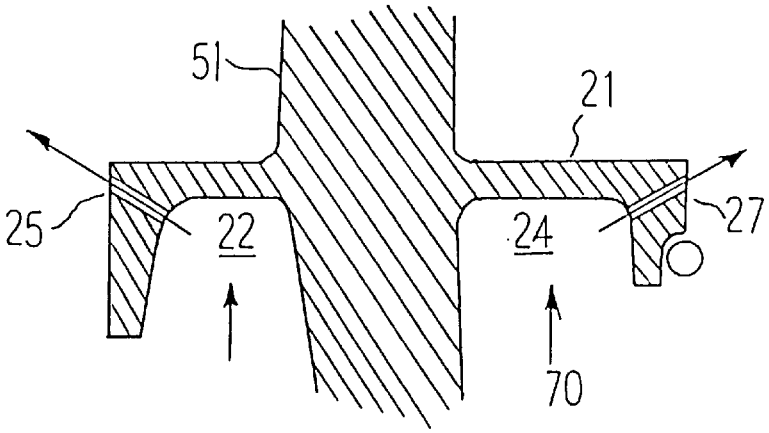

FIGS. 2(*a*)–(*b*) show a gas turbine moving blade platform of a second embodiment according to the present invention, wherein FIG. 2(*a*) is a plan view of the platform and FIG. 2(*b*) is a cross sectional view taken on line 2(*b*)—2(*b*) of FIG. 2(*a*). In FIG. 2(*a*), numeral 21 designates a platform, numerals 22, 23, 24 designate cavities formed in the platform 21 and numeral 25 designates cooling holes, which are formed on one side portion of the platform 21 in communication with the cavity 22, so that cooling air is blown therethrough at an angle upwardly at a side end of the one side portion of the platform 21, as will be described later. Numerals 26, 27 also designate cooling holes, which communicate with the cavities 23, 24, respectively, on the other side portion of the platform 21 so that the cooling air is blown therethrough likewise angularly upward.

Numeral 28 designates also a cooling hole, which is formed in a single piece in communication with the cavity 22 so that the cooling air is blown therethrough angularly upwardly at a rear portion of the platform 21. In this rear portion of the platform 1, there is provided no other cooling hole in consideration of facilitating the working process.

FIG. 2(*b*), which is a cross sectional view taken on line 2(*b*)—2(*b*) of FIG. 2(*a*), shows the cavities 22, 24 which are formed in the platform 21 and the cooling holes 25, 27 which are bored in both side end portions of the platform 1, and communicate with the cavities 22, 24, respectively. The cooling holes extend angularly upward so as to open at both side ends thereof, so that the cooling air is blown therefrom upwardly.

In the platform 21 of the second embodiment constructed as described above, an impingement plate 11 is not provided as in the first embodiment and further the cooling hole 28 in the rear portion of the platform 21 is provided in a single piece only, thereby the working process of the platform 21 is greatly simplified. The cooling air 70 flows directly into the cavities 22, 23, 24, respectively, so as to fill therein for cooling these portions of the cavities uniformly and then the cooling air flows angularly upward through the cooling holes 25, 26, 27 on both side portions of the platform 21 and through the single cooling hole 28 at the rear portion thereof for cooling the respective portions therearound so as to then flow out thereof.

The platform 21 of the second embodiment is effective in a case where a main flow gas of the gas turbine is of a comparatively low temperature. And, the cooling of the rear portion of the platform is effected mainly by the cavity 24 so that the cooling hole in the rear portion thereof is made in a necessary minimum number for enhancement of the workability of the platform and yet the cooling effect of the cavities 22, 23, 24 is sufficient for effecting the same uniform cooling of the platform as that effected by the first embodiment.

Figure 3A:
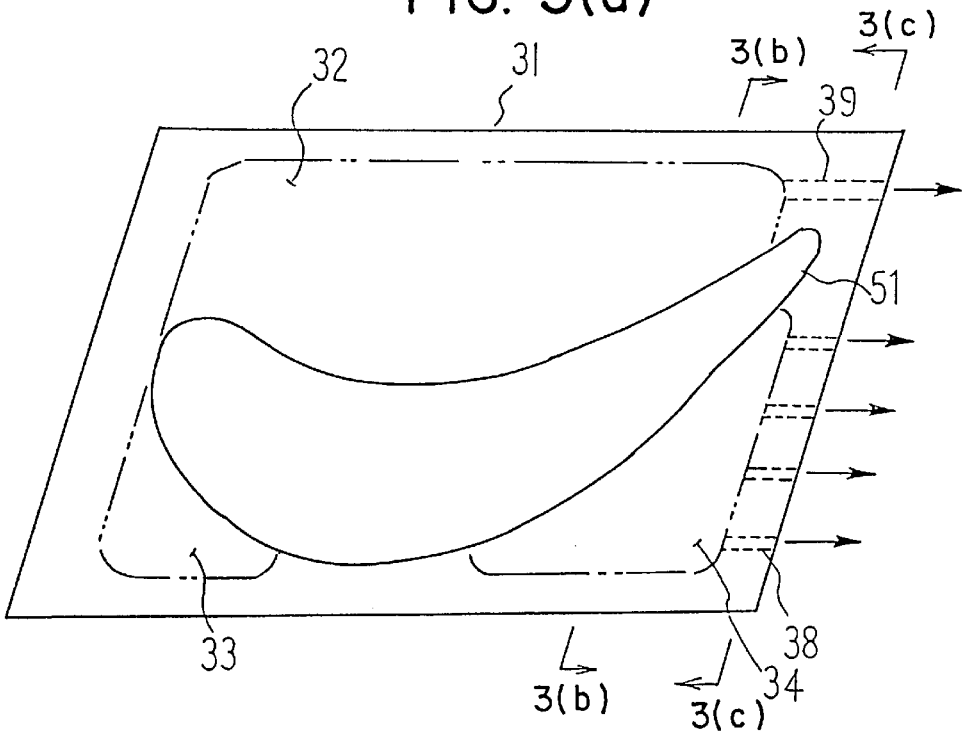
FIGS. 3(*a*)–3(*c*) show a gas turbine moving blade platform of a third embodiment according to the present invention, wherein FIG. 3(*a*) is a plan view of the platform, FIG. 3(*b*) is a cross sectional view taken on line 3(*b*)—3(*b*) of FIG. 3(*a*) and FIG. 3(*c*) is a cross sectional view taken on line 3(*c*)—3(*c*) of FIG. 3(*a*).
Figure 3B:
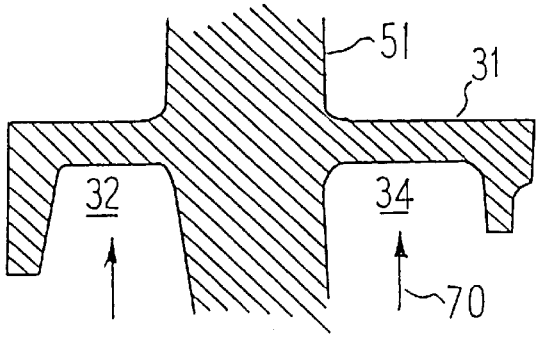
Figure 3C:
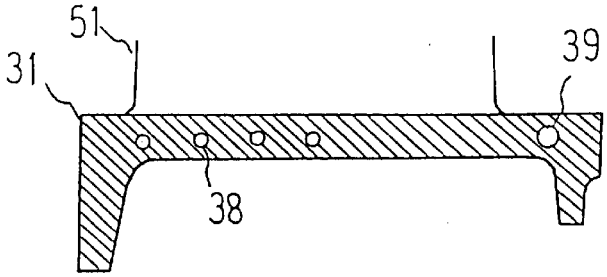

FIGS. 3(*a*)–3(*c*) show a gas turbine moving blade platform of a third embodiment according to the present invention, wherein FIG. 3(*a*) is a plan view of the platform, FIG. 3(*b*) is a cross sectional view taken on line 3(*b*)—3(*b*) of FIG. 3(*a*) and FIG. 3(*c*) is a cross sectional view taken on line 3(*c*)—3(*c*) of FIG. 3(*a*). In FIG. 3(*a*), numeral 31 designates a platform, numeral 51 designates a moving blade and numerals 32, 33, 34 designate cavities formed in the platform 31. Numeral 38 designates cooling holes, which are bored in a rear portion of the platform 31 communicating with the cavity 34 and extend at an angle upwardly from a lower surface of the platform 31 so as to open at a rear end thereof, like the cooling holes 8 of the first embodiment and the cooling hole 28 of the second embodiment. Numeral 39 also designates a cooling hole bored in the rear portion of the platform 31 and communicating with the cavity 32 and extending angularly upward.

In FIG. 3(*b*) which is a cross sectional view taken on line 3(*b*)—3(*b*) of FIG. 3(*a*), there are formed the cavities 32, 34 in the platform 31. Also, in FIG. 3(*c*) which is a cross sectional view taken on line 3(*c*)—3(*c*) of FIG. 3(*a*), there are bored the cooling holes 38 and the cooling hole 39 in the rear portion of the platform 31.

In the platform 31 of the third embodiment described above, in further consideration of the workability of the platform, all of the cooling holes on both side portions of the platform are omitted and only the cooling holes 38, 39 are provided in the rear portion.

In the platform 31, cooling air 70 flows into the cavities 32, 33, 34, respectively, and thereby approximately the entire portion of the platform 31 is cooled uniformly. That is, the platform 31 of the third embodiment is appropriate for the case where necessary cooling of the platform is almost satisfied by the cavities 32, 33, 34. Thus, the platform 31 is used effectively for this case, so that uniform cooling of the platform 31 is attained as well as there is obtained a further advantage in the workability of the platform in relation to the second embodiment.

Figure 4A:
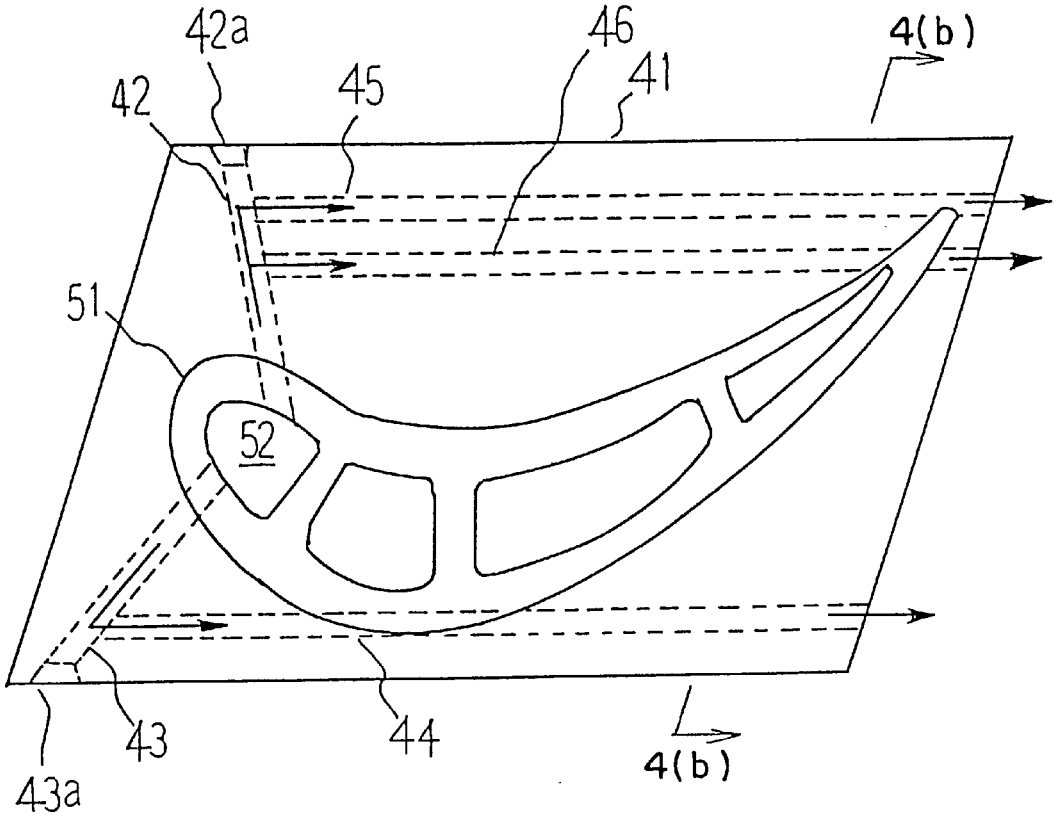
FIGS. 4(*a*)–4(*b*) show a gas turbine moving blade platform of a fourth embodiment according to the present invention, wherein FIG. 4(*a*) is a plan view of the platform and FIG. 4(*b*) is a cross sectional view taken on line 4(*b*)—4(*b*) of FIG. 4(*a*).
Figure 4B:
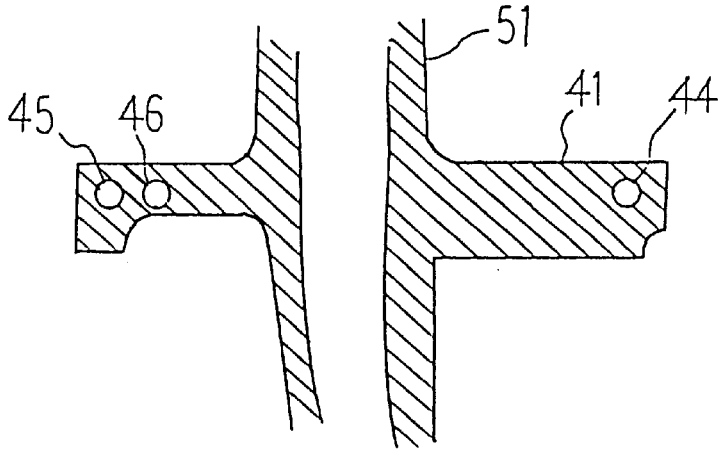

FIGS. 4(*a*)–4(*b*) show a gas turbine moving blade platform of a fourth embodiment according to the present invention, wherein FIG. 4(*a*) is a plan view of the platform and FIG. 4(*b*) is a cross sectional view taken on line 4(*b*)—4(*b*) of FIG. 4(*a*). In FIG. 4(*a*), numeral 41 designates a platform and numeral 51 designates a moving blade. Numerals 42, 43 designate cooling passages, which are provided in communication with a leading edge passage 52 of the moving blade 51. The cooling passages 42, 43 are bored from respective side ends of the platform 41 in order to pass through the respective side portions for ease of the working process and covers 42*a*, 43*a* are attached to opening portions thereof, respectively, so as to close the respective side ends.

Two cooling passages 45, 46 are provided in one side portion of the platform 41 and the cooling passage 42 communicates with the cooling passages 45, 46. Also, there is provided a cooling passage 44 in the other side portion of the platform and the cooling passage 43 communicates with the cooling passage 44. The cooling passages 44, 45, 46 are constructed so as to open at a rear end surface of the platform 41 so that cooling air flows out thereof. In FIG. 4(*b*), the arrangement of the cooling passages 44, 45, 46 is shown and cooling of the platform 41 is effected by the cooling passages 44, 45, 46, not by the cavities as in the first to third embodiments.

In the platform 41 as mentioned above, cooling air for cooling the moving blade 51 is led portionally into the cooling passages 42, 43 from the leading edge passage 52 of the moving blade 51 so as to flow through the linearly formed cooling passages 44, 45, 46 so that the entire portion of the platform 41 is cooled. In the fourth embodiment, there is no inclined cooling passage as is provided in the prior art nor are there cooling holes in the peripheral portions such as those employed in the first to third embodiments with the result that the workability of the platform is optimized.

According to the platform 41 of the fourth embodiment, both of the side end portions of the platform 41 are cooled by the cooling passages 44, 45 and the central portion thereof is cooled by the cooling passage 46. Although the platform 41 is inferior to the first to third embodiments in the cooling performance, if workability of the platform is considered, it is the best embodiment. It is to be noted that although the cooling passage 46 has been described with respect to the example of the single passage at the central portion, two or more passages thereof are more preferable if such is allowable in terms of the design of the platform.

Figure 5A:
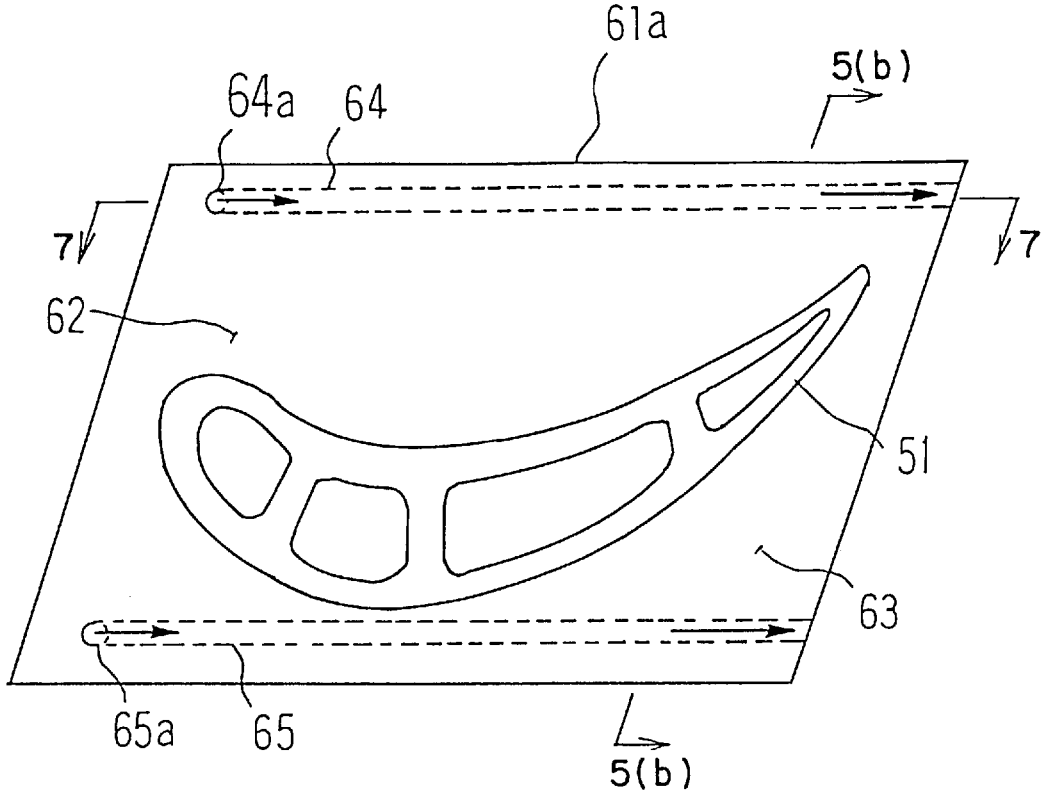
FIGS. 5(*a*)–5(*b*) show a gas turbine moving blade platform of a fifth embodiment according to the present invention, wherein FIG. 5(*a*) is a plan view of the platform and FIG. 5(*b*) is a cross sectional view taken on line 5(*b*)—5(*b*) of FIG. 5(*a*).
Figure 5B:
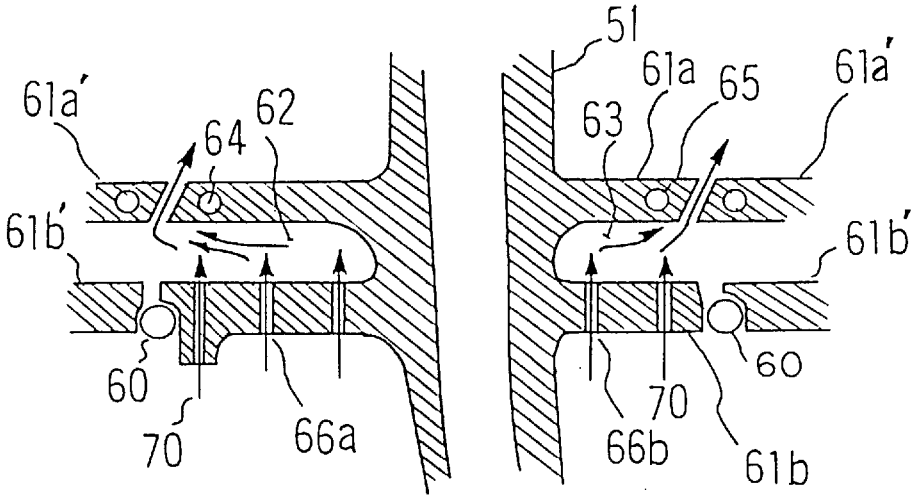

A fifth embodiment according to the present invention will be described with reference to FIGS. 5(*a*) to 7. FIGS. 5(*a*)–5(*b*) show a gas turbine moving blade platform of the fifth embodiment, wherein FIG. 5(*a*) is a plan view thereof and FIG. 5(*b*) is a cross sectional view taken on line 5(*b*)—5(*b*) of FIG. 5(*a*).

In FIGS. 5(*a*) and (*b*), numeral 61*a* designates an upper platform and numeral 61*b* designates a lower platform. The platform consists of the upper platform 61*a* and the lower platform 61*b* as shown in FIG. 5(*b*). Numerals 62, 63 designate cavities, which are formed between the upper and lower platforms 61*a*, 61*b* on both sides of a moving blade 51. Numerals 64, 65 designate cooling passages, which are bored in the upper platform 61*a* along both side portions thereof and connect at one end thereof to holes 64*a*, 65*a*, respectively, at a front portion of the platform and open at the other end thereof at a rear end surface of the platform. The holes 64*a*, 65*a* extend vertically in the front portion of the platform so as to pass through a portion of the upper platform 61*a* and communicate with the cavities 62, 63.

As shown in FIG. 5(*b*), the platform, including the upper platform 61*a* and the lower platform 61*b*, is disposed such that respective side ends of the upper platform 61*a* and the lower platform 61*b* stand closely to respective side ends of an upper platform 61*a*' and a lower platform 61*b*' of a moving blade, which is adjacent to the moving blade 51 in a blade rotational direction, with a seal pin 60 being disposed therebetween. A multiplicity of holes 66*a*, 66*b* are bored in the lower platform 61*b* so as to pass through into the cavities 62, 63 from an inner side thereof (rotor side).

Figure 6:
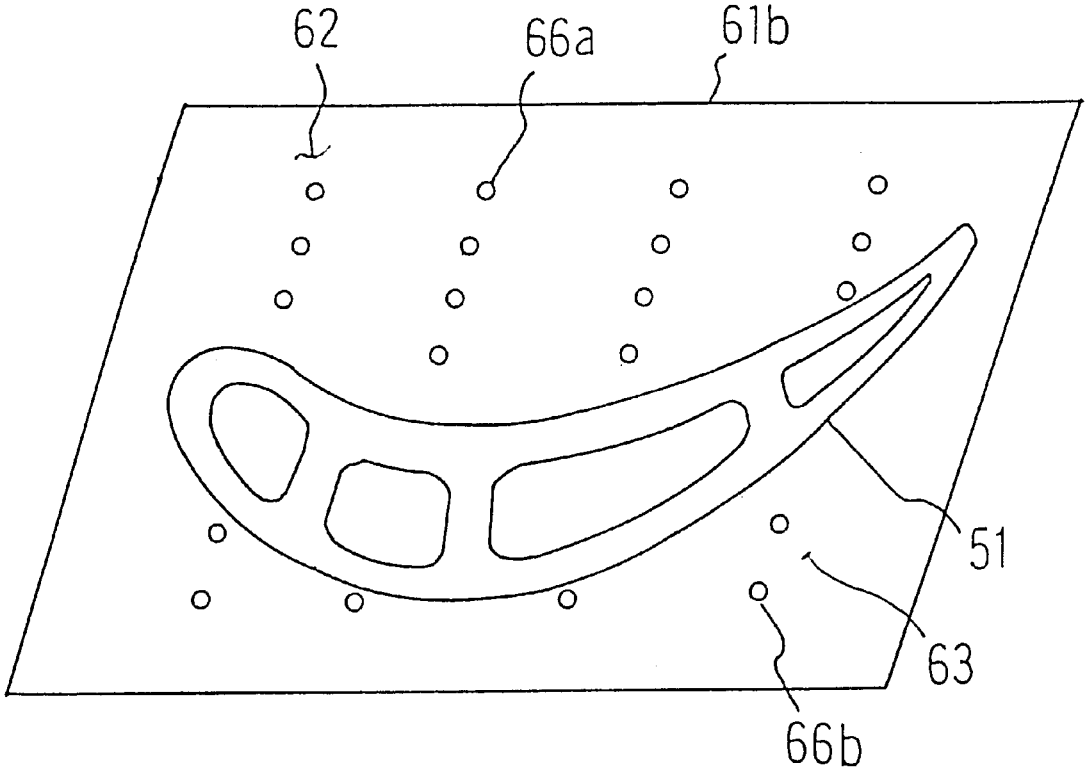
FIG. 6 is a plan view of a lower platform of the platform of FIG. 5.

FIG. 6 is a plan view of the lower platform 61*b* of the above-mentioned platform. As shown there, in an entire plane portion of the lower platform 61*b*, the multiplicity of holes 66*a*, 66*b* are bored in an array and pass through into the cavities 62, 63, respectively.

Figure 7:
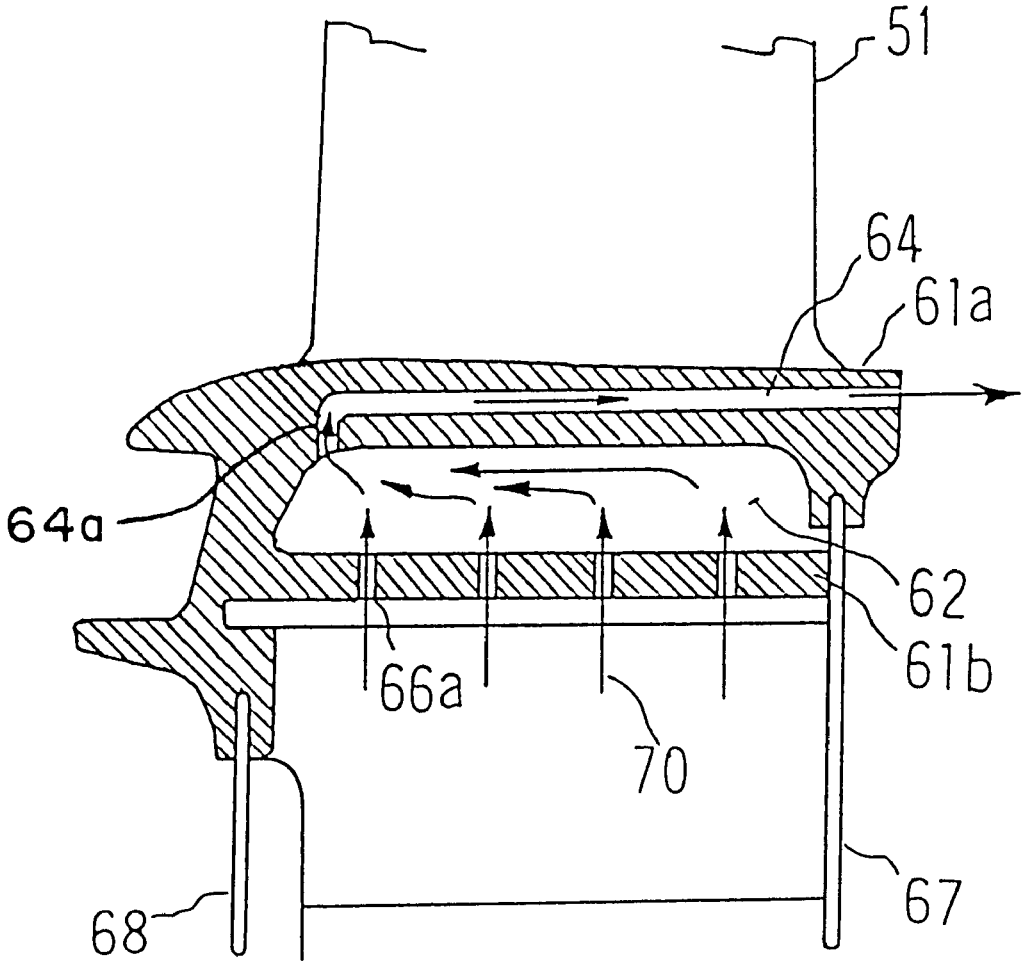
FIG. 7 is a contracted cross sectional view taken on line 7—7 of FIG. 5(*a*).
Figure 8:
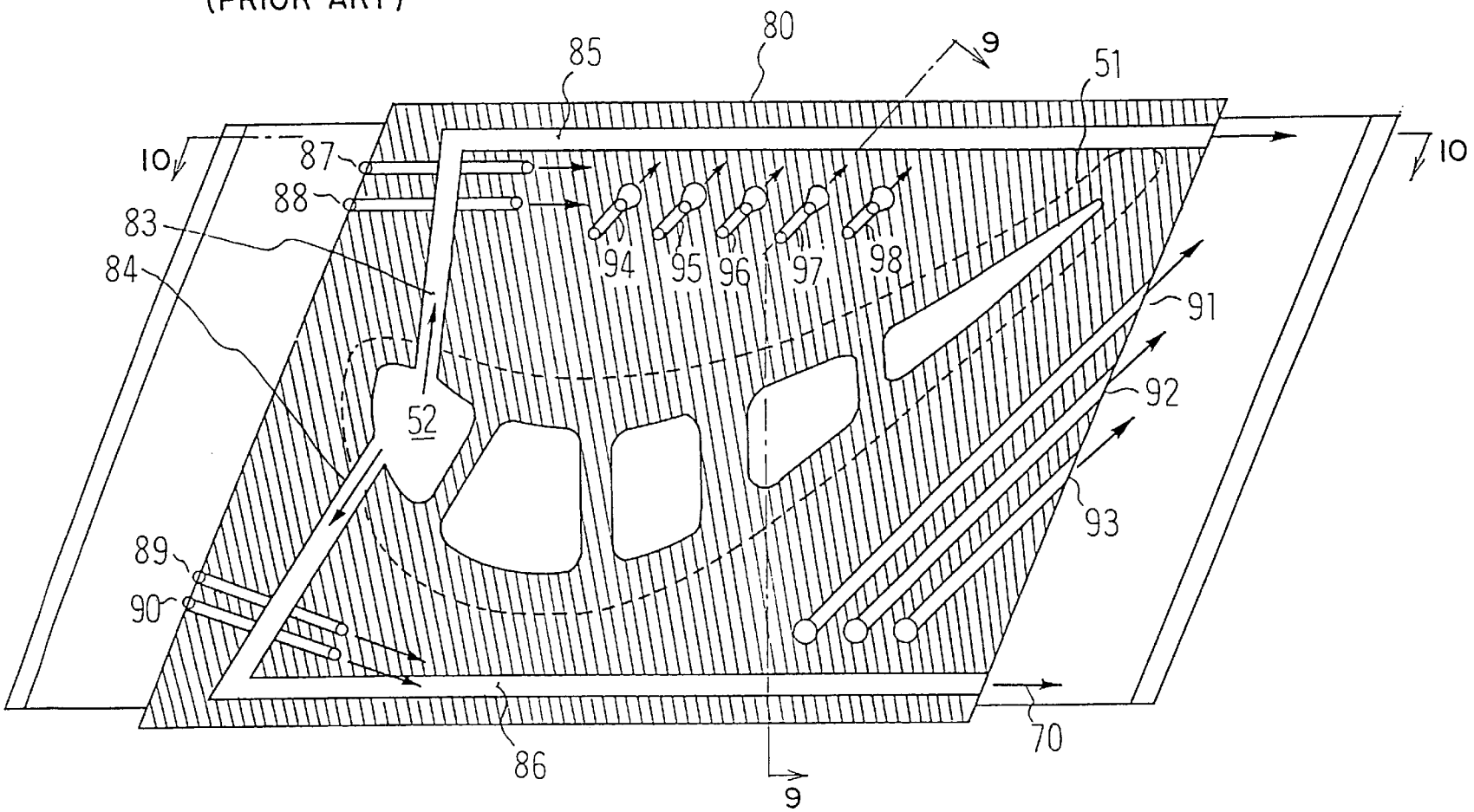
FIG. 8 (PRIOR ART)
FIG. 8 is a cross sectional view of a representative prior art gas turbine moving blade platform.
Figure 9:
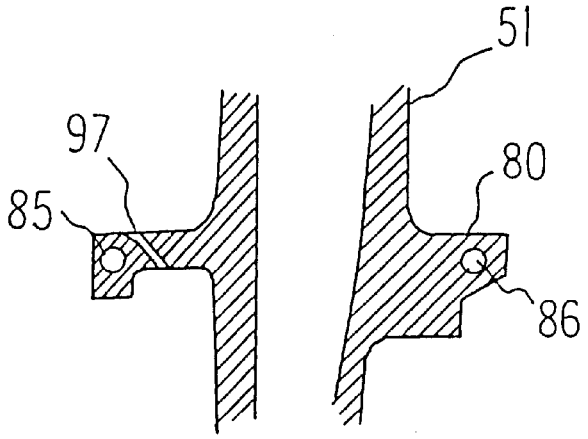
FIG. 9 (PRIOR ART)
FIG. 9 is a contracted cross sectional view taken on line 9—9 of FIG. 8.
Figure 10:
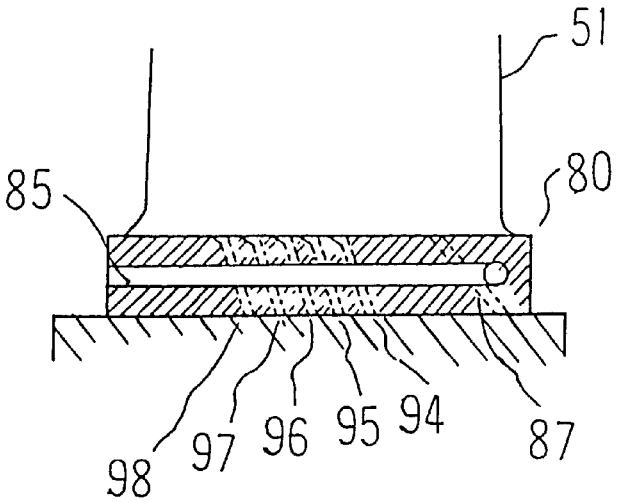
FIG. 10 (PRIOR ART)
FIG. 10 is a contracted cross sectional view taken on line 10—10 of FIG. 8.

FIG. 7 is a contracted cross sectional view taken on line 7—7 of FIG. 5(*a*). In FIG. 7, as already described in FIGS. 5 and 6, there are bored in the upper platform 61*a* the cooling passage 64, which extends in the front and rear direction, and the hole 64*a*, which extends vertically to connecting the cooling passage 64 and the cavity 62 in the front portion of the upper platform 61*a*. In the lower platform 61*b*, the multiplicity of holes 66*a* are provided in an array and pass through into the cavity 62 from the inner side (rotor side) . Numerals 67, 68 designate seal plates provided at the front and rear portions of the platform for sealing the interior thereof.

In the platform constructed as mentioned above, as shown in FIG. 5(*b*), cooling air 70 flows into the cavities 62, 63 from the inner side (rotor side) of the moving blade via the multiplicity of holes 66*a*, 66*b* form in the lower platform 61*b* in order to flow toward the front portion of the platform while cooling inner wall surfaces of the cavities 62, 63 uniformly, and then the cooling air flows into the cooling passages 64, 65 provided in the side end portions of the upper platform 61*a* via the holes 64*a*, 65*a* provided in the upper platform 61*a*.

According to the platform of the fifth embodiment as described above, the platform is constructed by the upper and lower platforms 61*a*, 61*b* such that the cavities 62, 63 are formed therebetween. The cooling passages 64, 65 are provided in the upper platform 61*a* on both side portions thereof and the multiplicity of holes 66*a*, 66*b* are arrayed over the entire plane portion of the lower platform 61*b* passing through into the cavities 62, 63 from the inner side (rotor side). The cooling air 70 flows into the cavities 62, 63 from the inner side of the lower platform 61*b* through the holes 66*a*, 66*b* and then enters the cooling passages 64, 65 of the upper platform 61*a* through the holes 64*a*, 65*a* so as to flow out of the rear end surface thereof. By use of such construction, the entire platform can be made in a simple structure comprising the upper and lower large platforms

61*a,* 61*b,* the linearly formed cooling passages 64, 65, the short holes 64*a* and 65*a,* 66*a* and 66*b,* etc. and thus the complicated and inclined cooling passages, as used in the prior art, are eliminated which facilitates the platform working process.

Further, the construction is made such that the cavities 62, 63 are formed and the cooling air 70 is introduced into the cavities 62, 63 through the multiplicity of holes 66*a,* 66*b,* thereby the entire planes of the upper and lower platforms 61*a,* 61*b* can be cooled uniformly and both of the side end portions of the upper platform 61*a.* which are exposed to a high temperature combustion gas, are cooled effectively by the cooling passages 64, 65. Hence, the cooling effect of the entire platform is increased.

It is to be noted that although the multiplicity of holes 66*a.* 66*b,* described above, are arrayed in linear rows in FIG. 6, the present invention is not limited thereto but, naturally, the arrangement thereof may be made in a zigzag form or even irregularly if a uniform cooling of the entire plane of the lower platform 61*b* is ensured.

In the first to third embodiments described above, there are formed the cavities in the platform and provided the cooling holes communicating with the cavities at the peripheral portions of the cavities, thereby the entire portion of the platform can be cooled uniformly and the cooling air passages and cooling air supply lines in the platform can be simplified with the result that the working process of the platform is facilitated. Also, in the fourth embodiment, there are eliminated such complicated and inclined cooling passages as are used in the prior art and the linearly formed cooling passages are provided instead, thereby the workability of the platform is enhanced further.

The fifth embodiment includes the cavities formed between the upper and lower platforms, the cooling passages on both side portions of the upper platform, and the multiplicity in holes of the lower platform. By this construction, the complicated and inclined passages of the platform cooling lines, as used in the prior art, are eliminated resulting in a simple structure and enhanced workability as well as a uniform cooling of the platform with a high cooling effect.

The invention has been described with respect to the embodiments as illustrated but the present invention is not limited thereto but naturally may include with various modifications in the structure within the scope of the following claims.

What is claimed is:

1. A gas turbine moving blade platform comprising:

a first cooling passage provided in said platform on a first side of the moving blade and having first and second ends, wherein said first end of said first cooling passage communicates with a leading edge passage of the moving blade, and said second end of said first cooling passage opens in a first side end surface of said platform;

a second cooling passage provided in said platform on a second side of the moving blade and having first and second ends, wherein said first end of said second cooling passage communicates with the leading edge passage of the moving blade, and said second end of said second cooling passage opens in a second side end surface of said platform;

a first cover for closing said second end of said first cooling passage in the first side end surface of said platform;

a second cover for closing said second end of said second cooling passage in the second side end surface of said platform; and at least three linear cooling passages formed in said platform, each of said linear cooling passages communicating at one end with one of said first and second cooling passages and opening at another end in a rear end surface of said platform.

2. A gas turbine moving blade platform as claimed in claim 1, wherein said first and second cooling passages are formed by boring through the platform from the respective side end faces of the platform to the leading edge passage of the moving blade.

3. A gas turbine moving blade platform as claimed in claim 1, wherein two of said linear cooling passages extend from the rear end surface of said platform to said second cooling passage, and one of said linear cooling passages extends from the rear end surface of said platform to said first cooling passage.

* * * * *